US012613057B2

(12) United States Patent
Groenewald

(10) Patent No.: US 12,613,057 B2
(45) Date of Patent: Apr. 28, 2026

(54) REFRIGERATION SYSTEM AND METHOD

(71) Applicant: MBGSHOLDINGS PTY LTD, Bayswater (AU)

(72) Inventor: Wynand Groenewald, Hartbeespoort (ZA)

(73) Assignee: MBGSHOLDINGS PTY LTD, Bayswater (AU)

( * ) Notice: Subject to any disclaimer, the term of this patent is extended or adjusted under 35 U.S.C. 154(b) by 40 days.

(21) Appl. No.: 18/577,044

(22) PCT Filed: Jul. 6, 2022

(86) PCT No.: PCT/AU2022/050704
§ 371 (c)(1),
(2) Date: Jan. 5, 2024

(87) PCT Pub. No.: WO2023/279157
PCT Pub. Date: Jan. 12, 2023

(65) Prior Publication Data

US 2025/0020368 A1 Jan. 16, 2025

(30) Foreign Application Priority Data

Jul. 6, 2021 (AU) ..... 2021902052
Feb. 25, 2022 (AU) ..... 2022900444

(51) Int. Cl.
*F25B 41/20* (2021.01)
*F25B 5/02* (2006.01)
*F25B 9/10* (2006.01)

(52) U.S. Cl.
CPC ..... *F25B 5/02* (2013.01); *F25B 9/10* (2013.01); *F25B 41/20* (2021.01)

(58) Field of Classification Search
CPC .. F25B 5/02; F25B 41/20; F25B 41/22; F25B 9/10; F25B 9/008; F25B 9/08;
(Continued)

(56) References Cited

U.S. PATENT DOCUMENTS

2007/0119207 A1 5/2007 Oshitani et al.
2012/0167601 A1 7/2012 Cogswell et al.
(Continued)

FOREIGN PATENT DOCUMENTS

EP 2754978 7/2014
WO 2014076904 5/2014
(Continued)

*Primary Examiner* — Miguel A Diaz
(74) *Attorney, Agent, or Firm* — Cook Alex Ltd.

(57) ABSTRACT

A carbon dioxide refrigeration system including a $CO_2$-based refrigerant circuit including a refrigerant compression device, a refrigerant cooling heat exchanger, a refrigerant heating heat exchanger, an expansion device, a flash tank receiver configured to separate refrigerant from the refrigerant cooling heat exchanger into gas refrigerant and liquid refrigerant, at least one ejector, and a three-way valve. The valve is configured to transition the system between a first mode in which gas refrigerant from the receiver is caused to pass to the refrigerant compression device where it is blended with vapour refrigerant from the flash tank, and a second mode in which the refrigerant compression device is supplied refrigerant exclusively from the flash tank receiver system further includes a controller configured to automatically activate the three-way valve to transition the system directly from the first to the second mode of operation upon determining a particular condition.

17 Claims, 4 Drawing Sheets

(58) Field of Classification Search
CPC ..... F25B 43/006; F25B 2400/16; F25B 2309/06; F25B 2341/00; F25B 2341/001; F25B 2341/0012; F25B 2341/0013; F25B 2341/0015
See application file for complete search history.

(56) References Cited

U.S. PATENT DOCUMENTS

| | | | | |
|---|---|---|---|---|
| 2016/0223234 | A1 | 8/2016 | Vaisman | |
| 2017/0343245 | A1 | 11/2017 | Fredslund et al. | |
| 2018/0058738 | A1 | 3/2018 | Yokoyama et al. | |
| 2021/0302077 | A1* | 9/2021 | Xu ..... | F25B 6/04 |

FOREIGN PATENT DOCUMENTS

| | | |
|---|---|---|
| WO | 2016180487 | 11/2016 |
| WO | 2021113423 | 6/2021 |

* cited by examiner

REFRIGERATION SYSTEM AND METHOD

CROSS-REFERENCE TO RELATED APPLICATION

The present application is a U.S. National Stage Application of International PCT Application No. PCT/AU2022/050704, filed Jul. 6, 2022, which claims priority to Australian Provisional Patent Application No. 2022900444, filed Feb. 25, 2022 and Australian Provisional Patent Application No. 2021902052, filed Jul. 6, 2021, all of which are hereby incorporated herein by reference.

FIELD OF THE INVENTION

The present invention relates to a refrigeration system utilising an ejector arrangement to increase energy efficiency, specifically for applications that experience high temperature ambient conditions.

BACKGROUND OF THE INVENTION

Carbon Dioxide ($CO_2$) refrigeration systems, using $CO_2$ as a refrigerant (commonly known as R744 refrigerant), have increasingly become commercially feasible, energy efficient and an environmentally acceptable technology in recent years. R744 refrigerant is a natural, non-toxic and non-flammable refrigerant. Numerous component improvements have been introduced in recent times to improve the efficiency of these systems, particularly at high ambient conditions, including high-pressure liquid and vapour ejector technology.

The most simplistic configuration for a $CO_2$ system is known as a 'booster' system (described in greater detail below). This system does not make use of any additional energy improvements and has been successfully implemented in temperate and cold climates resulting in an inherent energy efficiency advantage as compared with traditional Hydrofluorocarbon (HFC) systems.

However, $CO_2$ system efficiency has lagged HFC systems in environments with high ambient conditions. In these conditions, a $CO_2$ booster system will lose its efficiency advantage as gas cooler outlet temperatures increase above a point where the system can maintain a traditional vapour-compression cycle (i.e. temperature at the condenser discharge of approximately 27 degrees Celsius and above), which typically occurs when dry-bulb ambient temperatures exceed approximately 25 degrees Celsius. It is at this point, when the ambient temperature can no longer maintain a $CO_2$ system in a subcritical mode that the system will start operating in transcritical mode, which typically entails a substantial decrease in system efficiency.

An ejector provides its primary benefits when a $CO_2$ refrigeration cycle is operating in transcritical mode, and hence is commonly used when a $CO_2$ system is used in high ambient temperatures. At the condenser (also referred to as a gas cooler) outlet, in ambient conditions of around 25 degrees Celsius or higher (or when a $CO_2$ system will typically start operating in transcritical mode), the ejector system utilises high pressure $CO_2$ to entrain and 'lift' lower-pressure $CO_2$ gas from other parts of the refrigeration circuit and inject the mixed gas into the receiver, thus substantially increasing the efficiency of the system in high ambient conditions. Analysis from various sources that is available to the refrigeration identity has confirmed that a $CO_2$ system using an ejector is more efficient than an HFC system at any ambient condition, and is more efficient than competing $CO_2$ technologies (both Parallel-Compression and High-Pressure-Cooling systems) at every ambient temperature over approximately 28 degrees Celsius.

A known $CO_2$ system (10) using an ejector (12) is shown in FIG. 1, in which it will be appreciated that such systems have a design similar to a standard refrigeration system. Such systems will typically operate in three modes, a baseline or "booster" mode, an "intermediate" mode in which parallel compression (or any other parallel step that utilises additional energy improvements) is activated, and "ejector" mode. In this regard, skilled readers will recognise that FIG. 1 depicts the flow that occurs in ejector mode only.

The system of FIG. 1 utilises medium temperature (MT) compressors (also referred to herein as refrigerant compression devices) (14) to compress and send refrigerant to a condenser (also referred to herein as a gas cooler, or a refrigerant cooling heat exchanger) (16) to reject unwanted heat. The refrigerant subsequently passes through the ejector (12) (which in baseline mode operates as a high pressure valve) to a receiver (also referred to herein as a gas tank receiver, or vessel) (18) which separates the refrigerant into gas and liquid phases.

Refrigerant in the liquid phase is sent from the receiver (18) to the evaporators (also referred to herein as refrigerant heating heat exchangers) (20). Liquid refrigerant that flows to each evaporator (20) first flows through an associated expansion valve (also referred to herein as an expansion device) (22). Since such refrigeration systems typically supply both refrigerators and freezers, there are two different pressure lines, i.e. a medium temperature (MT) line (24) which supplies the refrigerators, and a low temperature (LT) line (26) which supplies the freezers. The system further includes LT compressors (27) used to raise the pressure of the LT line (26) prior to blending with refrigerant from the MT line (24) at the MT suction.

Gas refrigerant (also known as flash gas) from the receiver (18) is managed differently depending upon the mode of operation of the system (10). For example, in baseline or booster mode, a flash gas bypass valve (28) is exclusively used to manage the vessel pressure by effectively ejecting the flash gas from the circuit. In the intermediate mode, the flash gas is taken directly out of the receiver (18) by a parallel compressor (or group of compressors) (30) that manage the gas by recompressing and discharging the flash gas into the common MT discharge line (31).

The ejector mode, shown in FIG. 1, is triggered by operating a three-way valve (32) operable to transition the system (10) from intermediate to ejector mode. This causes flash gas to flow through a bypass line (34) into the suction line of the MT compressors (14), whilst the parallel compressor (30) continues to operate. At the same time, 100% of the MT mass flow is caused to flow into the ejector (12). The ejector includes a main nozzle through which high pressure refrigerant from the condenser (16) enters, as well as a suction valve (opened only in ejector mode) which enables the MT mass flow of a much lower pressure to enter the ejector (12). By utilising the energy provided by the higher pressure refrigerant, the MT mass flow is entrained (transported and compressed) using the venturi effect, i.e. by the higher pressure refrigerant passing through the ejector (12), such that the blend of refrigerants can be injected into the receiver (18). Accordingly, in ejector mode, having never re-compressed the MT refrigerant from the evaporators (20), the refrigerant is effectively re-injected into the receiver (18) and re-used.

In ejector mode, since the MT compressors (14) are not used to manage MT suction, they instead begin to manage the receiver flash gas and therefore shift from standard suction operation of typically −6 to −8 saturation suction temperature (SST) to typically +2 SST, thereby significantly reducing the pressure differential between suction and discharge at the MT compressors (14). This substantial increase in suction temperature and reduction in pressure differential greatly increases compressor efficiency and capacity.

The SST values mentioned above and throughout this document are exemplary only, and these values may vary depending upon factors including the ambient temperature (since there is likely to be a reduced entrainment of the MT suction in lower ambient conditions), and how the evaporator cases accommodate the higher liquid temperatures in the receiver (since if evaporator case performance is affected, a controller will typically lower the receiver pressure/temperature).

As mentioned above, the parallel compressor (30) continues to operate in ejector mode, and typically the suction into the MT compressors (14) is lifted to match the parallel compressor (30) such that both sets of compressors (14) and (30) are effectively operating as if they were a single suction group responsible for managing the required suction pressure of the evaporators, thereby indirectly managing the receiver vessel pressure. In other words, the evaporators (20) are driving the requirements of the combined MT and parallel compressor suction group. The parallel compressors (30) adjust to match the MT compressor (14) objective of managing the evaporator case pressures, and an indirect result is that the receiver pressure is also managed.

For the system (10) shown in FIG. 1 to operate in ejector mode, the system (10) must first change from baseline mode (where flash gas is managed exclusively by the flash gas bypass valve (28)) to the intermediate mode (where flash gas is managed by the parallel compressor (30) and not exclusively by the flash gas bypass valve (28)), and then from intermediate mode to ejector mode (where the ejector (12) entrains the entire mass flow of MT refrigerant from the evaporators (20) before being re-injected into the receiver (18) where it is re-used).

The parallel compressor (30) will have a minimum mass flow that it can accommodate, which corresponds with the opening degree of the flash gas bypass valve (28). Accordingly, the trigger that causes the system to transition from baseline mode to the intermediate (e.g. parallel compression) mode will typically occur when the flash gas bypass valve (28) reaches a predetermined opening percentage. The system may transition from the intermediate mode back to the baseline mode once the generated flash gas is lower than the minimum mass flow of the parallel compressor (30). However, the system controller will typically be programmed to avoid continuous transitioning between the baseline and intermediate modes.

In order to transition from the intermediate mode to the ejector mode, the trans-critical operating range described above will need to be reached and detected by the system. There are also two further requirements that need to be satisfied, namely, discharge pressure and mass flow which are typically pre-defined in the controller. Compressors need to run at a specific capacity to overcome the minimum mass flow capabilities of particular ejectors, hence the transition from intermediate mode to ejector mode will also depend upon the size of the ejectors selected for use in the system. In other words, the size of the ejectors will affect the minimum mass flow that is required before the ejectors can operate to provide a benefit. In addition, the discharge pressure of the ejector(s) needs to reach a stated discharge pressure. If all of these conditions are satisfied, then the system will transition into ejector mode. Again, the controller is typically programmed to prevent the system from transitioning in or out of ejector mode for as long as possible, to ensure that the system does not transition between the intermediate and ejector modes too frequently. For example, the controller may be programmed such that the transition to ejector mode does not occur until the trans-critical operating range has been clearly reached and the system is unlikely to transition out of that range (e.g. once the gas cooler outlet has reached 33 to 35 degrees Celsius).

Intermediate mode as described above, in which parallel compression is triggered, typically requires the installation of one to three additional parallel compressors (30), as well as the additional piping and controls necessary to manage the transition between the three modes of operation. Accordingly, the inclusion of an intermediate stage usually requires substantial capital expenditure and assembly time.

It would be beneficial for a carbon dioxide refrigeration system to avoid the significant capital expenditure and assembly time requirements described above. In addition, the Applicant has recognised the need to achieve greater energy savings when utilising carbon dioxide refrigeration systems in high ambient conditions. In existing carbon dioxide refrigeration systems as above that uses parallel compressors to accommodate excess flash gas from the receiver (when transitioning baseline mode to intermediate mode), the flash gas is re-compressed and discharged at approximately 3.5 SST instead of being drawn into the MT suction at approximately −6 to −8 SST, hence giving rise to an energy saving. However, the energy saving is not without cost since one or more parallel compressors need to be operated to achieve the benefit. Therefore, the use of an intermediate mode as described above gives rise to an energy saving although, this is achieved at a cost and there remains a need for an improved system that achieves energy savings whilst avoiding (or at least significantly reducing) the otherwise additional capital costs that are usually incorrect.

It is an object of the present invention to overcome, or at least ameliorate, some of the aforementioned problems or to provide the public with one or more useful alternatives.

The reference to any prior art in this specification is not, and should not be taken as, an acknowledgement or any suggestion, that the prior art forms part of the common general knowledge.

SUMMARY OF THE INVENTION

A carbon dioxide ($CO_2$) refrigeration system including a $CO_2$-based refrigerant circuit including a refrigerant compression device, a refrigerant cooling heat exchanger for passing refrigerant received from said compression device at a high pressure in heat exchange relationship with a cooling medium, a refrigerant heating heat exchanger for passing refrigerant at a low pressure in heat exchange relationship with a heating medium, and an expansion device disposed in the $CO_2$-based refrigerant circuit downstream of said refrigerant cooling heat exchanger and upstream of said refrigerant heating heat exchanger a flash tank receiver disposed in the $CO_2$-based refrigerant circuit downstream of said refrigerant cooling heat exchanger and upstream of said expansion device, the flash tank receiver operable to separate refrigerant from the refrigerant cooling heat exchanger into gas refrigerant and liquid refrigerant at least one ejector disposed in the $CO_2$-based refrigerant circuit downstream of said refrigerant cooling heat exchanger and upstream of said flash tank receiver a three-way valve disposed at an entry side of the refrigerant compression device and operable to transition the mode of operation of the refrigeration system between a first mode in which the flash tank receiver receives refrigerant exclusively from the refrigerant cooling heat exchanger, and gas refrigerant from the flash tank receiver is caused to pass through a first refrigerant line from the flash tank receiver to the refrigerant compression device such that refrigerant passing from the refrigerant heating heat exchanger to the refrigerant compression device is blended with said vapour refrigerant from the flash tank a second mode in which the gas refrigerant from the flash tank receiver is caused to pass through a second refrigerant line from the flash tank receiver to the refrigerant compression device such that the refrigerant compression device is supplied refrigerant exclusively from the flash tank receiver, wherein refrigerant from the refrigerant heating heat exchanger is diverted through a third refrigerant line to the at least one ejector where the refrigerant is blended with refrigerant from the refrigerant cooling heat exchanger, the flash tank receiver thereby receiving a mix of refrigerants from the refrigerant heating heat exchanger and the refrigerant cooling heat exchanger a controller operatively associated with the three-way valve, the controller operable to automatically activate or schedule the activation of the three-way valve, to thereby cause the refrigeration system to transition directly from the first to the second mode of operation, upon determining a particular condition, the particular condition including one or more of, dry-bulb ambient temperature increasing from a first temperature below approximately 25 degrees Celsius to a second temperature equal to or greater than approximately 25 degrees Celsius, and a temperature at a discharge of the refrigerant cooling heat exchanger increasing from a first temperature below approximately 27 degrees Celsius to a second temperature equal to or greater than approximately 27 degrees Celsius The person skilled in the relevant field of technology will appreciate that a $CO_2$ refrigeration system configured according to the statement in paragraph avoids any requirement for an intermediate parallel compression mode.

In an embodiment, the system further includes a flash gas bypass valve that is used in the first mode of operation to manage flash gas as it accumulates in the flash tank receiver with the flash gas bypass valve closed in the second mode of operation.

In an embodiment, the controller is operable to cause the refrigeration system to operate in said first mode until the three-way valve has been activated to cause the refrigeration system to operate in said second mode.

In an embodiment, the at least one ejector includes a nozzle through which high pressure refrigerant from the refrigerant cooling heat exchanger enters, and a suction valve, opened only in the second mode of operation, enables refrigerant of a much lower pressure from the refrigerant heating heat exchanger to enter the ejector and, by utilising the energy provided by the higher pressure refrigerant, the lower pressure refrigerant is entrained by the higher pressure refrigerant.

The entrainment is caused by a lift in refrigerant pressure resulting from the ejector operating under a high pressure differential, i.e. the high pressure differential between the discharge pressure (upstream of the ejector) and the receiver pressure (downstream of the ejector). In particular, as described above, the ejector creates a venturi or entrainment effect that lifts the pressure of medium temperature (MT) refrigerant passing from the refrigerant heating heat exchanger to the flash tank receiver.

In the first mode of operation, the ejector suction valve is always closed and hence in the first mode of operation the at least one ejector acts as a high pressure valve for high pressure refrigerant from the refrigerant cooling heat exchanger.

In the second mode of operation, the ejector suction valve is opened to allow refrigerant from the refrigerant heating heat exchanger to be mixed with the refrigerant from the refrigerant cooling heat exchanger to form a pre-compressed gas and liquid that is subsequently injected into the flash tank receiver.

In an embodiment, the at least one ejector is configured to accommodate the entire mass flow of refrigerant from the refrigerant cooling and heating heat exchangers in the second mode of operation.

In an embodiment, the refrigeration system includes a plurality of refrigerant compression devices.

When ambient temperature is near or above 25 degrees Celsius, the temperature at the refrigerant cooling heat exchanger discharge may increase above approximately 27 degrees Celsius and refrigerant is no longer able to undergo a phase change and condense into liquid in the condenser. Maintaining the second mode of operation during these conditions ensures that the efficiency of the system is increased whilst operating in transcritical conditions where there is no phase change.

In an embodiment, the controller is operable to maintain the refrigeration system in said second mode across all advantageous ambient conditions. For example, the controller may be operable to maintain the refrigeration system in said second mode whilst the particular condition is maintained, and activate the three-way valve, or schedule activation of the three-way valve, to transition the mode of operation from the second mode to the first mode of operation if the temperature at the refrigerant cooling heat exchanger discharge is detected as decreasing below 27 degrees Celsius, and/or if the dry-bulb temperature is detected as decreasing below approximately 25 degrees Celsius.

In an embodiment, the system further includes at least one sensor responsible for detecting the dry-bulb ambient temperature and/or the temperature at the discharge of the refrigerant cooling heat exchanger.

In an embodiment, the refrigeration system further includes, arranged in parallel with the refrigerant heating heat exchanger and associated expansion device, a second refrigerant heating heat exchanger and associated second expansion device. The second refrigerant heating heat exchanger may be configured to pass refrigerant at a low pressure in heat exchange relationship with a heating medium, the refrigerant heating heat exchanger configured to output medium temperature (MT) refrigerant, and the second refrigerant heating heat exchanger configured to output low temperature (LT) refrigerant.

Accordingly, the MT refrigerant is suitable for providing cooling in refrigerators, and the LT refrigerant is suitable for providing cooling in freezers, hence the refrigeration system is capable of servicing a building requiring both refrigerator and freezer cooling.

According to another aspect, the present invention provides a carbon dioxide ($CO_2$) refrigeration method utilising a $CO_2$ refrigeration system according to any one or more of the preceding statements, the method including operating the refrigeration system in the first mode of operation, determining the particular condition, and transitioning the mode of operation from the first mode to the second mode of operation by automatically activating, or scheduling the activation of, the three-way valve, and operating the refrigeration system in said second mode of operation for at least as long as the dry-bulb temperature remains equal to or above approximately 25 degrees Celsius, and/or the temperature at the discharge of the refrigerant cooling heat exchanger remains equal to or above approximately 27 degrees Celsius.

According to yet another aspect, the present invention provides a carbon dioxide ($CO_2$) refrigeration method utilising a $CO_2$ refrigeration system according to any one or more of the preceding statements, the method including operating the refrigeration system in the first mode of operation when temperature at the refrigerant cooling heat exchanger discharge is detected as being below approximately 27 degrees Celsius, and based upon determining that the temperature at the refrigerant cooling heat exchanger discharge has reached or exceeded approximately 27 degrees Celsius, automatically transitioning, or scheduling transitioning of, by the controller, the mode of operation from the first mode to the second mode.

In an embodiment, the method further includes, based upon detecting that the temperature at the refrigerant cooling heat exchanger discharge has reduced below approximately 27 degrees Celsius, using the controller to automatically transition, or to schedule transitioning, of the mode of operation from the second mode to the first mode.

In a yet further aspect, the present invention provides a carbon dioxide ($CO_2$) refrigeration method utilising a $CO_2$ refrigeration system according to any one or more of the preceding statements, the method including operating the refrigeration system in the first mode of operation when the dry-bulb ambient temperature is detected below approximately 25 degrees Celsius, and based upon detecting that the dry-bulb ambient temperature has reached or exceeded approximately 25 degrees Celsius, automatically transitioning, or scheduling the transitioning of, by the controller, the mode of operation from the first mode to the second mode.

In an embodiment, the method further includes, based upon detecting that the dry-bulb ambient temperature has reduced below approximately 25 degrees Celsius, using the controller to automatically transition, or schedule transitioning, of the mode of operation from the second mode to the first mode.

BRIEF DESCRIPTION OF THE DRAWINGS

Features of the present disclosure are illustrated by way of example and not limited in the following Figure(s), in which like numerals indicate like elements, in which.

DETAILED DESCRIPTION OF EMBODIMENT(S) OF THE INVENTION

Figure 2:
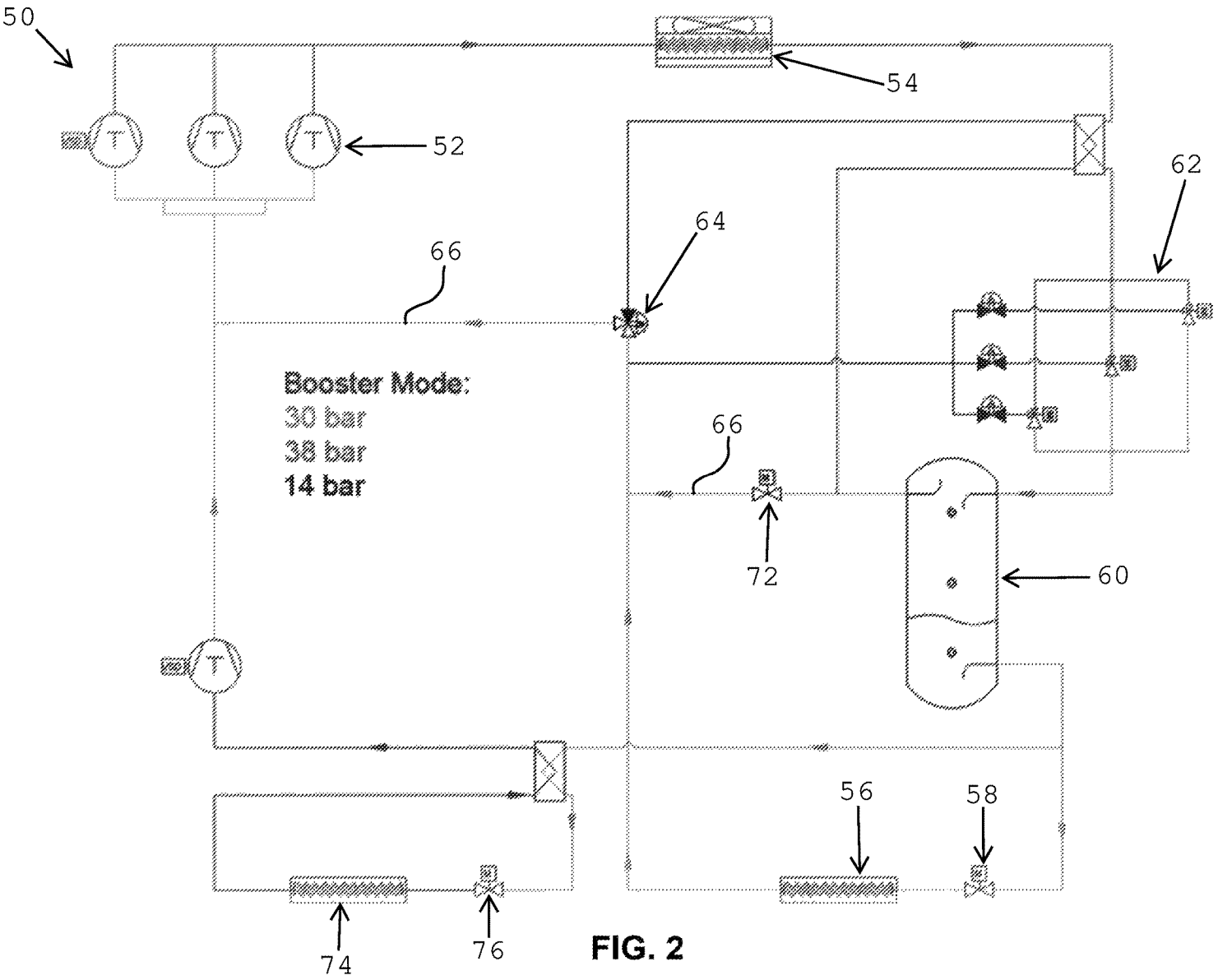
FIG. 2 illustrates a carbon dioxide refrigeration system according to an embodiment of the present invention operating in a first mode of operation.
Figure 3:
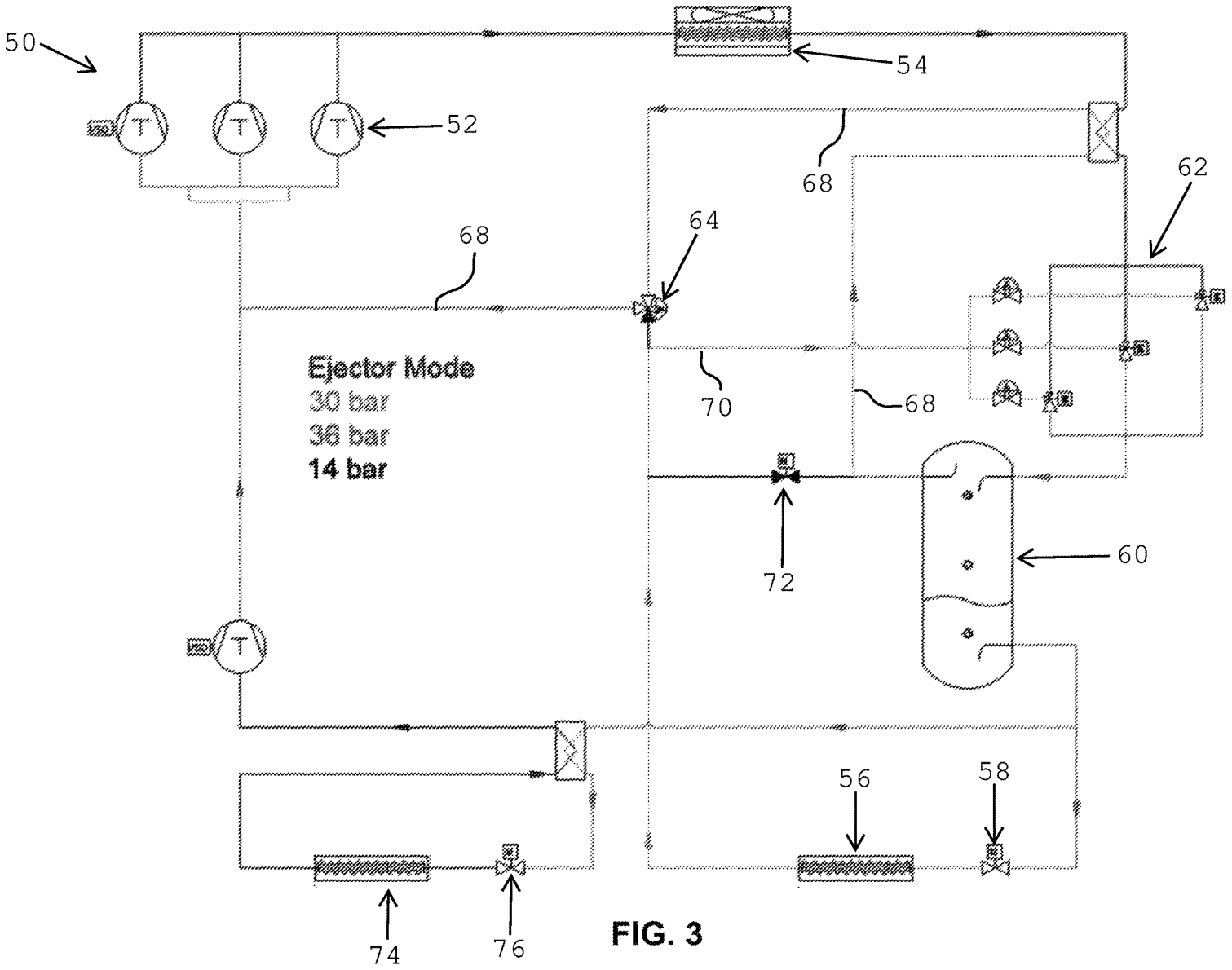
FIG. 3 illustrates the carbon dioxide refrigeration system of FIG. 2 operating in a second mode of operation after transitioning directly from the first mode of operation.

The present invention relates to a carbon dioxide ($CO_2$) refrigeration system (10) with embodiments configured and detailed in FIGS. 2 and 3.

The refrigeration system (50) includes a $CO_2$-based refrigerant circuit including one or more refrigerant compression devices (52) (also referred to herein as Medium Temperature or MT compressors), a refrigerant cooling heat exchanger (54) (also referred to herein as a gas cooler or condenser), and a refrigerant heating heat exchanger (56) (also referred to herein as an evaporator with medium temperature or MT output) with an associated expansion device (58) (also referred to herein as an expansion valve) upstream of the refrigerant heating heat exchanger (56). The skilled reader will appreciate that the refrigerant cooling heat exchanger (54) is responsible for passing refrigerant received from the compression devices (52) at a high pressure in heat exchange relationship with a cooling medium, and that the refrigerant heat exchanger (56) is responsible for passing refrigerant at a low pressure in heat exchange relationship with a heating medium.

The $CO_2$-based refrigeration system (50) depicted in FIGS. 2 and 3 also includes a flash tank receiver (60) downstream of the refrigerant cooling heat exchanger (54) and upstream of the expansion device (58), at least one ejector (62) downstream of the refrigerant cooling heat exchanger (54) and upstream of the flash tank receiver (60), and a three-way valve (64) disposed at an entry side of the refrigerant compression devices (52) and operable to transition between different modes of operation of the refrigeration system (50) as described in greater detail below.

FIG. 2 depicts the refrigerator system (50) operating in a first mode of operation, and FIG. 3 illustrates the refrigeration system (50) operating in a second mode of operation. Whilst not shown in FIG. 2 or 3, such a refrigeration system (50) typically includes a controller for operating each of the components at the required time, including transitioning the system, or scheduling the system to transition, between the first and second modes of operation.

In the first mode of operation depicted in FIG. 2, the flash tank receiver (60) receives refrigerant exclusively from the refrigerant cooling heat exchanger (54), and vapour refrigerant from the flash tank receiver (60) is caused to pass through a first refrigerant line (66) from the flash tank receiver (60) to the refrigerant compression devices (52) such that refrigerant passing from the refrigerant heating heat exchanger (56) to the refrigerant compression devices (52) is blended with the vapour refrigerant from the flash tank receiver (60).

In the second mode of operation depicted in FIG. 3, the vapour refrigerant from the flash tank receiver (60) is caused to pass through a second refrigerant line (68) from the flash tank receiver (60) to the refrigerant compression devices (52) such that the refrigerant compression devices (52) are supplied refrigerant exclusively from the flash gas receiver (60). Refrigerant from the refrigerant heating heat exchanger (56) is diverted through a third refrigerant line (70) to the at least one ejector (62) where the refrigerant is blended with refrigerant from the refrigerant cooling heat exchanger (54). In this way, the flash tank receiver (60) receives a mix of refrigerants from the refrigerant heating heat exchanger (56) and the refrigerant cooling heat exchanger (54).

Also shown in the system (50) of FIGS. 2 and 3 is a flash gas by-pass valve (72) open in the first mode of operation in FIG. 2, but closed in the second mode of operation in FIG. 3. In the first mode of operation, the flash gas by-pass valve (72) is used to manage flash gas as it accumulates in the flash gas receiver (60).

In the first mode of operation depicted in FIG. 2, the ejector suction value is always closed and hence, in the first mode of operation the at least one ejector (62) acts as a high pressure valve for receiving high pressure refrigerant exclusively from the refrigerant cooling heat exchanger (54). Such ejectors typically include a nozzle through which high pressure refrigerant from the refrigerant cooling heat exchanger (54) enters. The ejectors further include a suction valve that is open during the second mode of operation, and enables refrigerant of a much lower pressure from the refrigerant heating heat exchanger (56) to enter the ejector (62) and, by utilising the energy provided by the higher pressure refrigerant, the lower pressure is entrained by the higher pressure refrigerant by the venturi effect.

The abovementioned entrainment is caused by a lift in refrigerant pressure resulting from the ejector operating under a high pressure differential, i.e. the high pressure differential between the discharge pressure (upstream of the ejector (62) and the pressure in the receiver (60) (downstream of the ejector (62)).

In the first mode of operation depicted in FIG. 2, the ejector suction valve is always closed and hence, as mentioned earlier, the at least one ejector (62) acts as a high pressure valve for receiving high pressure refrigerant exclusively from the refrigerant cooling heat exchanger (54). In the second mode of operation, the ejector suction valve is opened to allow refrigerant from the refrigerant heating heat exchanger (56) to be mixed with the refrigerant from the refrigerant cooling heat exchanger (54) to form a pre-compressed vapour and liquid that is subsequently injected into the flash tank receiver (60). Accordingly, whilst in the first mode of operation, at least one ejector (62) is required to accommodate refrigerant exclusively from the refrigerant cooling heat exchanger (54), in the second mode of operation, the at least one ejector (62) is required to also accommodate refrigerant from the refrigerant heating heat exchanger (56), i.e. the entire mass flow of the MT refrigerant as well.

The at least one ejector (62) needs to be appropriately categorised to accommodate the entire mass flow of refrigerant from the refrigerant cooling and heating heat exchangers (54) and (56) in the second mode of operation. If the ejector is not appropriately configured to accommodate the entire mass flow, the system will shut down in the second mode of operation due to an accumulation of pressure in the system.

As mentioned previously, the system will transition from the first to the second mode, or will be scheduled to transition from the first to the second mode, when a particular condition is detected. In this regard, the system may further include one or more sensors (not shown) responsible for detecting the dry-bulb ambient temperature. According to an embodiment, the particular condition that causes a transition from the first to the second mode of operation is when dry-bulb ambient temperature exceeds approximately 25 degrees Celsius, and/or when the temperature at the discharge of the refrigerant cooling heat exchanger (54) increases to or above approximately 27 degrees Celsius. Indeed, when ambient temperature is near or above 25 degrees Celsius, the temperature at the discharge of the refrigerant cooling heat exchanger (54) will typically increase above approximately 27 degrees Celsius at which point refrigerant is no longer able to undergo a phase change and condense into liquid in the heat exchanger (54). Transitioning to the second mode of operation when there is no longer a phase change, causes the efficiency of the system to increase whilst operating in trans-critical conditions.

It will be appreciated that FIGS. 2 and 3 also illustrate a second refrigerant heating heat exchanger (74) and associated second expansion device (76) upstream thereof. The second refrigerant heating heat exchanger (74) is also configured to pass refrigerant at a low pressure in heat exchange relationship with a heating medium, but is configured to output low temperature (LT) refrigerant rather than MT refrigerant. Refrigeration systems are typically required to provide refrigeration as well as freezing, and the reason for including the second evaporator 74 is to ensure that the system (50) is suitable for providing cooling in freezers in addition to cooling in refrigerators. In other words, the MT refrigerant from the refrigerant heating heat exchanger (56) is suitable for providing cooling in refrigerators, and the LT refrigerant from the refrigerant heating heat exchanger (74) is suitable for providing cooling in freezers, hence the system (50) is capable of servicing a building requiring both refrigerator and freezer cooling.

In the second mode of operation, the system (50) no longer takes a portion of the flash gas mass flow and re-compressing same. Instead, the entire volume from the refrigerant heating heat exchanger (56) is drawn through the ejector (62), and this has a number of effects.

Firstly, since the refrigerant compression devices (52) are not used to manage MT suction, they instead begin to manage the receiver flash gas, thereby significantly reducing the pressure differential between suction and discharge at the refrigerant compression devices (52). As depicted in the first mode of operation in FIG. 2, the suction pressure of the refrigerant compression devices (52) is 30 bar, whereas in the second mode of operation in FIG. 3, the suction pressure at the refrigerant compression devices (52) is 36 bar. This increase in suction pressure results in a reduction in pressure differential.

Figure 1:
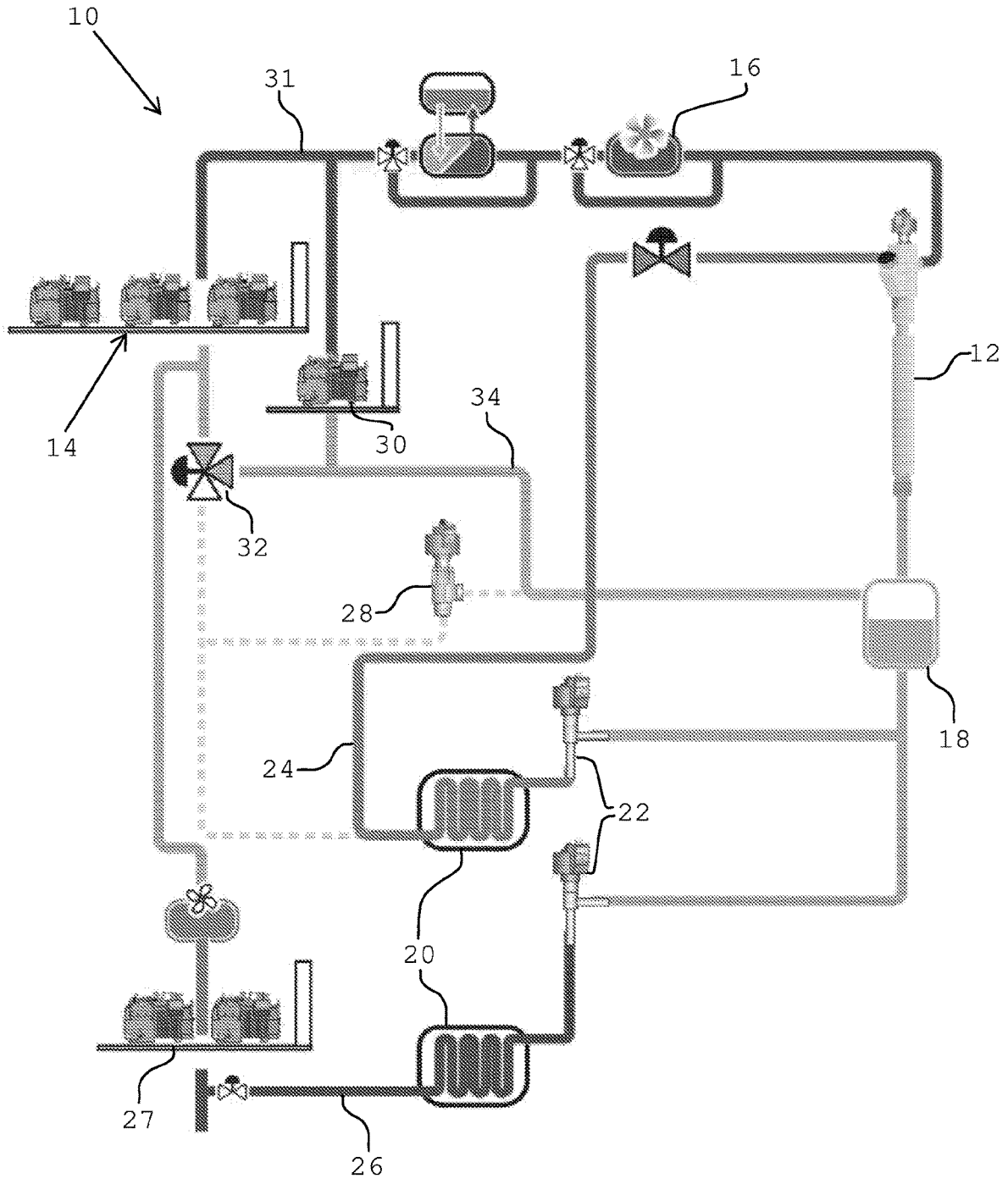
FIG. 1 (PRIOR ART)
FIG. 1 illustrates a prior art carbon dioxide refrigeration system operating in ejector mode.

Secondly, by transitioning from the first mode directly to the second mode and thereby avoiding any requirement for an intermediate mode, such as a parallel compression mode, there are greater energy savings as compared with transitioning from the booster to the intermediate mode using the system of FIG. 1. This is because the entire volume from the refrigerant heating heat exchanger (56) is drawn through the at least one ejector (62), thereby increasing the entire SST of the pack at an earlier stage than would otherwise be the case using the system of FIG. 1, i.e. when transitioning from the intermediate mode to the ejector mode. The result is a substantially greater overall energy increase according to the arrangements of the present invention.

As, compared with traditional $CO_2$ refrigeration systems utilising ejector technology, such as the system shown in FIG. 1 which transitions from a booster mode to an intermediate parallel compression mode rather than from booster mode directly to ejector mode, less work is required of the MT refrigerant compression devices (52) to achieve the same or a comparable refrigeration effect. According to test results, system co-efficient of performance (COP) increases during the direct mode change from the first to the second mode, and since there is no longer a requirement for an intermediate parallel compression stage involving additional components and additional control requirements, there is no requirement for additional capital expenditure as for arrangements according to prior systems. As a result of the higher suction pressure, there is also an increase in refrigeration capacity (also allowing for a reduction in the size of the system).

The controller (not shown) may be operable to maintain the refrigeration system (50) in either the first or second mode across all advantageous ambient conditions. According to an embodiment, the controller may be programmed to ensure that the refrigeration system (50) operates in the first mode of operation when temperature at the refrigerant cooling heat exchanger discharge is detected as below approximately 27 degrees Celsius, and upon detecting that the temperature at the refrigerant cooling heat exchanger discharge has reached or exceeded approximately 27 degrees Celsius, automatically transition (or schedule transitioning) to the second mode of operation. Likewise, based upon detecting that the temperature at the refrigerator cooling heat exchanger discharge has reduced below 27 degrees Celsius, the system (50) may transition (or schedule transitioning) from the second mode of operation back to the first mode of operation.

Figure 4:
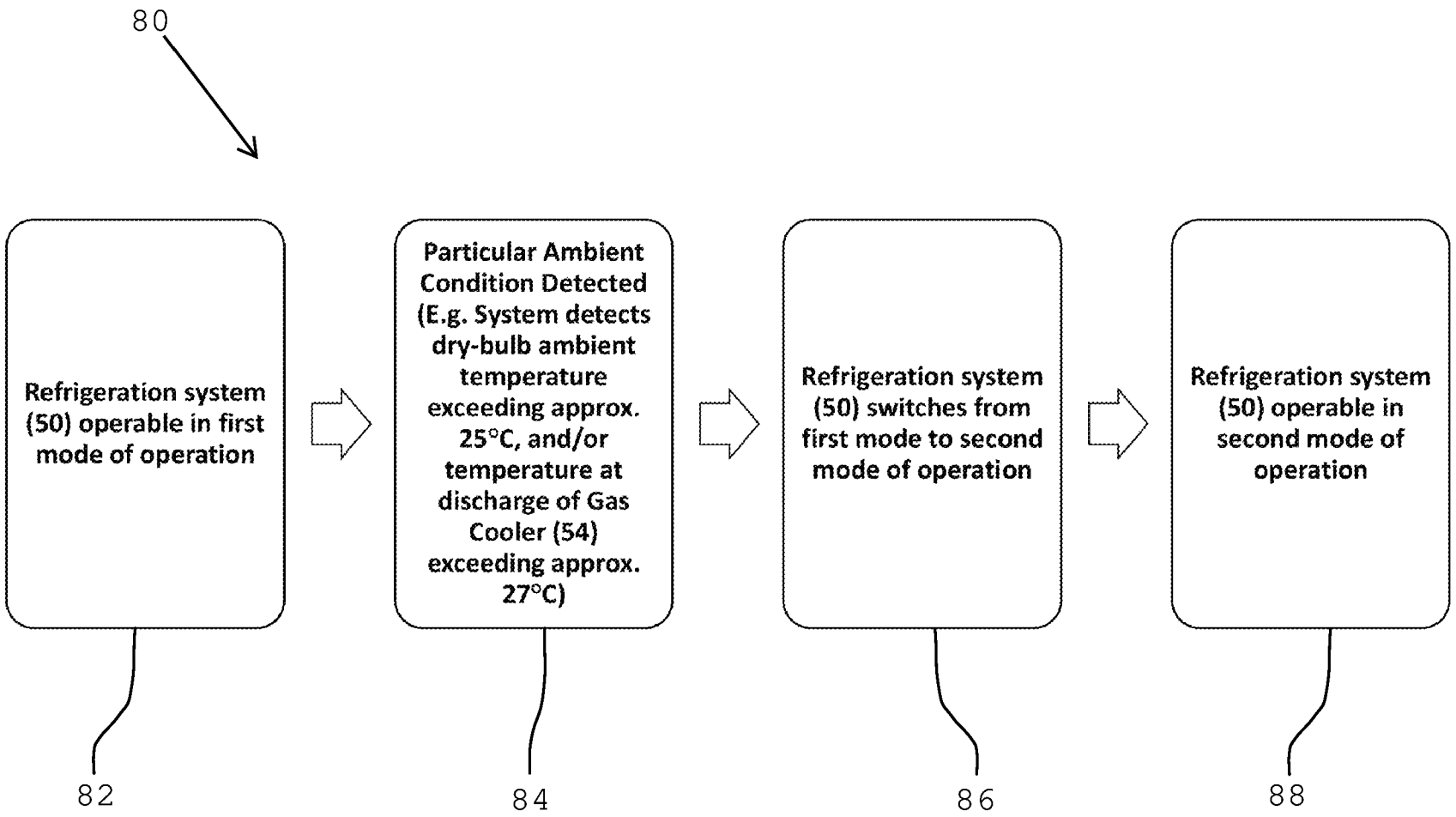
FIG. 4 illustrates an exemplary flow diagram representing a method of operating the carbon dioxide refrigeration system of FIGS. 2 and 3.

FIG. 4 illustrates an exemplary flow diagram (80) reflecting a method of operating the refrigeration system (50) illustrated in FIGS. 2 and 3. In particular, the flow diagram (80) depicts how the different modes of operation are triggered according to an embodiment, starting from operation (82) of the system (50) in the first mode of operation, detection (84) of a particular condition (i.e. a dry-bulb ambient temperature reaching or exceeding approximately 25 degrees Celsius and/or a temperature at the discharge of gas cooler (54) reaching or exceeding approximately 27 degrees Celsius), transitioning (86) or scheduling transitioning from the first mode of operation to the second mode of operation, and subsequent to transitioning to the second mode of operation, maintaining operation (88) of the system (50) in the second mode of operation.

As described earlier, it will also be appreciated that the transitioning process may occur in reverse, i.e. when the dry-bulb ambient temperature decreases below approximately 25 degrees Celsius and/or the temperature at the discharge of gas cooler (54) decreases below approximately 27 degrees Celsius. When an appropriate reduction in temperature is recorded, the three-way valve (64) may be operated again (or scheduled to be operated) to cause the mode of operation to transition from the second mode of operation to the first mode of operation.

Whilst two particular conditions for triggering the transition between operating modes are described herein (e.g. for the transition from the first to the second mode, the particular condition is the dry-bulb ambient temperature reaching or exceeding approximately 25 degrees Celsius and/or the temperature at the discharge of gas cooler (54) reaching or exceeding approximately 27 degrees Celsius), it is to be understood that there is no requirement for both of these conditions to be detected. In other words, it may be preferable in certain applications to have both of these two conditions detected prior to transitioning from the first to the second mode of operation, whereas in other applications, it may be preferable to initiate the transition from the first to the second mode based upon only one of these particular conditions being detected. In this regard, the present invention is not intended to be limited to both conditions being detected prior to activation of the three-way valve (64) to transition between the two modes. For example, a system may be configured in which only one of these conditions is monitored and hence the transition from the first mode to the second mode of operation, or scheduling of the transition between these two modes, is based solely upon the one particular condition being detected.

The reference throughout this specification to "scheduling" the transition between different modes of operation, or "scheduling" activation of the three-way valve, is intended to cover embodiments in which the transition between modes of operation is delayed by a predetermined amount of time, or until a further trigger is detected at an appropriate future stage, as opposed to occurring immediately upon detection of the particular condition. In this regard, the controller may be programmed to ensure that the system (50) operates in each mode of operation for a minimum run time. In one example, the controller may be programmed such that, upon detection of the particular condition, transitioning to the second mode is scheduled for a future time when it can be confirmed that the trans-critical operating range has clearly been reached and the system is unlikely to exit that range (e.g. once the temperature at the refrigerant cooling heat exchanger discharge has been detected as 33 to 35 degrees Celsius). In another example, the delay may be pre-programmed such that after a predetermined amount of time after determining the particular condition, transitioning from the first mode of operation to the second mode of operation will automatically occur (e.g. X hours or Y days or Z weeks after the particular condition has been determined).

Throughout this specification and the claims which follow, unless the context requires otherwise, the word "comprise", and variations such as "comprises" and "comprising", will be understood to mean the inclusion of a stated feature or step, or group of features or steps, but not the exclusion of any other feature or step, or group of features or steps.

The reference to any prior art in this specification is not, and should not be taken as, an acknowledgement or any suggestion that the prior art forms part of the common general knowledge.

The claims defining the invention are as follows:

1. A carbon dioxide ($CO_2$) refrigeration system including:

a $CO_2$-based refrigerant circuit including a refrigerant compression device, a refrigerant cooling heat exchanger for passing refrigerant received from said compression device at a high pressure in heat exchange relationship with a cooling medium, a refrigerant heating heat exchanger for passing refrigerant at a low pressure in heat exchange relationship with a heating medium of the refrigerant heating heat exchanger, and an expansion device disposed in the $CO_2$-based refrigerant circuit downstream of said refrigerant cooling heat exchanger and upstream of said refrigerant heating heat exchanger;

a flash tank receiver disposed in the $CO_2$-based refrigerant circuit downstream of said refrigerant cooling heat exchanger and upstream of said expansion device, the flash tank receiver configured to separate refrigerant from the refrigerant cooling heat exchanger into gas refrigerant and liquid refrigerant;

at least one ejector disposed in the $CO_2$-based refrigerant circuit downstream of said refrigerant cooling heat exchanger and upstream of said flash tank receiver;

a three-way valve disposed at an entry side of the refrigerant compression device and configured to transition the mode of operation of the refrigeration system between:

a first mode in which the flash tank receiver receives refrigerant exclusively from the refrigerant cooling heat exchanger, and gas refrigerant from the flash tank receiver is caused to pass through a first refrigerant line from the flash tank receiver to the refrigerant compression device such that refrigerant passing from the refrigerant heating heat exchanger to the refrigerant compression device is blended with said vapour refrigerant from the flash tank;

a second mode in which the gas refrigerant from the flash tank receiver is caused to pass through a second refrigerant line from the flash tank receiver to the refrigerant compression device such that the refrigerant compression device is supplied refrigerant exclusively from the flash tank receiver, wherein refrigerant from the refrigerant heating heat exchanger is diverted through a third refrigerant line to the at least one ejector where the refrigerant is blended with refrigerant from the refrigerant cooling heat exchanger, the flash tank receiver thereby receiving a mix of refrigerants from the refrigerant heating heat exchanger and the refrigerant cooling heat exchanger; and a controller operatively associated with the three-way valve, the controller configured to automatically activate or schedule the activation of the three-way valve, to thereby cause the refrigeration system to transition directly from the first to the second mode of operation, upon determining a particular condition, the particular condition including one or more of:

a dry-bulb ambient temperature increasing from a first temperature below approximately 25 degrees Celsius to a second temperature equal to or greater than approximately 25 degrees Celsius, and a temperature at a discharge of the refrigerant cooling heat exchanger increasing from a first temperature below approximately 27 degrees Celsius to a second temperature equal to or greater than approximately 27 degrees Celsius.

2. A system according to claim 1, further including:

a flash gas bypass valve used in the first mode of operation to manage gas refrigerant as it accumulates in the flash tank receiver, the flash gas bypass valve closed in the second mode of operation.

3. A system according to either claim 1, wherein the controller is configured to cause the refrigeration system to operate in said first mode until the three-way valve has been activated to cause the refrigeration system to operate in said second mode.

4. A system according to claim 1, wherein the at least one ejector includes a nozzle through which high pressure refrigerant from the refrigerant cooling heat exchanger enters, and a suction valve, opened in the second mode of operation, thereby enabling refrigerant of a lower pressure from the refrigerant heating heat exchanger to enter the ejector and, by utilising energy provided by the higher pressure refrigerant, the lower pressure refrigerant is entrained by the higher pressure refrigerant, the entrainment caused by a lift in refrigerant pressure resulting from a high pressure differential between the discharge pressure upstream of the ejector and the receiver pressure downstream of the ejector.

5. A system according to claim 4, wherein in the first mode of operation, the ejector suction valve is always closed and hence in the first mode of operation the at least one ejector is a high pressure valve for high pressure refrigerant from the refrigerant cooling heat exchanger.

6. A system according to claim 4, wherein in the second mode of operation, the ejector suction valve is opened to allow refrigerant from the refrigerant heating heat exchanger to be mixed with the refrigerant from the refrigerant cooling heat exchanger to form a pre-compressed gas and liquid that is subsequently injected into the flash tank receiver.

7. A system according to claim 1, wherein the at least one ejector is configured to accommodate the entire mass flow of refrigerant from the refrigerant cooling and heating heat exchangers in the second mode of operation.

8. A system according to claim 1, wherein the refrigeration system includes a plurality of refrigerant compression devices.

9. CX\A system according to claim 1, further including at least one sensor for detecting the dry-bulb ambient temperature and/or the temperature at the discharge of the refrigerant cooling heat exchanger.

10. A system according to claim 1, wherein the controller is configured to:

maintain the refrigeration system in said second mode whilst the particular condition is maintained, and activate the three-way valve, or schedule activation of the three-way valve, to transition the mode of operation from the second mode to the first mode of operation if the temperature at the refrigerant cooling heat exchanger discharge is detected as decreasing below approximately 27 degrees Celsius, and/or if the dry-bulb ambient temperature is detected as decreasing below approximately 25 degrees Celsius.

11. A system according to claim 1, further including an associated expansion device arranged in parallel with the refrigerant heating heat exchanger and a second refrigerant heating heat exchanger and associated second expansion device.

12. A system according to claim 11, wherein the second refrigerant heating heat exchanger is configured to pass refrigerant at a low pressure in heat exchange relationship with a heating medium of the second refrigerant heating heat exchanger, the refrigerant heating heat exchanger configured to output medium temperature (MT) refrigerant, and the second refrigerant heating heat exchanger configured to output low temperature (LT) refrigerant.

13. A carbon dioxide ($CO_2$) refrigeration method utilising a $CO_2$ refrigeration system according to claim 1, the method including:

operating the refrigeration system in said first mode of operation;

determining the particular condition, and transitioning the mode of operation from the first mode to the second mode of operation by automatically activating, or scheduling the activation of, the three-way valve; and operating the refrigeration system in said second mode of operation for at least as long as the dry-bulb ambient temperature remains equal to or above approximately 25 degrees Celsius, and/or the temperature at the discharge of the refrigerant cooling heat exchanger remains equal to or above approximately 27 degrees Celsius.

14. A carbon dioxide ($CO_2$) refrigeration method utilising a $CO_2$ refrigeration system according to claim 1, the method including:

operating the refrigeration system in the first mode of operation when the temperature at the refrigerant cooling heat exchanger discharge is detected as being below approximately 27 degrees Celsius; and based upon determining that the temperature at the refrigerant cooling heat exchanger discharge has reached or exceeded approximately 27 degrees Celsius, automatically transitioning, or scheduling transitioning of, by the controller, the mode of operation from the first mode to the second mode.

15. A method according to claim 14, further including:

based upon detecting that the temperature at the refrigerant cooling heat exchanger discharge has reduced below approximately 27 degrees Celsius, using the controller to automatically transition, or to schedule transitioning of, the mode of operation from the second mode to the first mode.

16. A carbon dioxide ($CO_2$) refrigeration method utilising a $CO_2$ refrigeration system according to claim 1, the method including:

operating the refrigeration system in the first mode of operation when the dry-bulb ambient temperature is determined as below approximately 25 degrees Celsius; and based upon detecting that the dry-bulb ambient temperature has reached or exceeded approximately 25 degrees Celsius, automatically transitioning, or scheduling the transitioning of, by the controller, the mode of operation from the first mode to the second mode.

17. A method according to claim 16, further including:

configurating the controller to automatically transition, or to schedule transitioning of, the mode of operation from the second mode back to the first mode upon determining that the dry-bulb ambient temperature is below approximately 25 degrees Celsius.

* * * * *